US008839778B2

(12) United States Patent
South

(10) Patent No.: US 8,839,778 B2
(45) Date of Patent: Sep. 23, 2014

(54) HYDRAULICALLY-ACTUATED, HORIZONTAL FLUSH-CUT RADIAL CONCRETE SAW AND TRIP HAZARD REMOVAL METHOD

(76) Inventor: Jeffery Robert South, American Fork, UT (US)

( * ) Notice: Subject to any disclaimer, the term of this patent is extended or adjusted under 35 U.S.C. 154(b) by 397 days.

(21) Appl. No.: 13/277,945

(22) Filed: Oct. 20, 2011

(65) Prior Publication Data

US 2013/0098346 A1 Apr. 25, 2013

(51) Int. Cl.
*B28D 1/04* (2006.01)

(52) U.S. Cl.
CPC ..... *B28D 1/04* (2013.01)
USPC ..... 125/13.01; 125/25; 451/359; 451/41

(58) Field of Classification Search
CPC ..... B24B 37/042; B24B 37/04; B28D 1/045; B28D 7/02; B28D 5/022; B28D 1/04; B28D 1/121; B28D 1/00; B23D 47/12; B23D 45/16
USPC ..... 125/25, 13.01; 451/359, 41
See application file for complete search history.

(56) References Cited

U.S. PATENT DOCUMENTS

| | | | | |
|---|---|---|---|---|
| 4,570,609 | A * | 2/1986 | Hogue | 125/13.01 |
| 5,570,677 | A * | 11/1996 | Chiuminatta et al. | 125/15 |
| 7,143,760 | B2 * | 12/2006 | Gardner | 125/25 |
| 8,118,018 | B1 * | 2/2012 | Sherment | 125/13.01 |
| 2004/0007226 | A1 * | 1/2004 | Denys | 125/13.01 |
| 2007/0163566 | A1 * | 7/2007 | Johnson et al. | 125/13.01 |
| 2007/0221188 | A1 * | 9/2007 | Donnerdal et al. | 125/13.01 |
| 2008/0173293 | A1 * | 7/2008 | Baratta | 125/15 |
| 2011/0037307 | A1 * | 2/2011 | Bollinger | 299/18 |

* cited by examiner

*Primary Examiner* — Joseph J Hail
*Assistant Examiner* — Marc Carlson
(74) *Attorney, Agent, or Firm* — Steven Rinehart

(57) ABSTRACT

A concrete saw is disclosed having a rigid metal frame, a hydraulic drive system, a water-cooled hub, and an axially rotatable trigger assembly comprising a 12 volt switch. The saw may include a hydraulic pump operable to supply pressurized hydraulic fluid to the drive system. In some embodiments, the saw may includes a flow sharing valve fluidly coupled to the hydraulic drive system to distribute the pressurized hydraulic fluid from the a hydraulic pump in a portable power pack. A method of removing trip hazards with the saw is also disclosed.

12 Claims, 7 Drawing Sheets

HYDRAULICALLY-ACTUATED, HORIZONTAL FLUSH-CUT RADIAL CONCRETE SAW AND TRIP HAZARD REMOVAL METHOD

BACKGROUND OF THE INVENTION

1. Field of the Invention

This invention relates to saws, and more particularly relates to hydraulically-powered concrete saws and trip hazard removal methods.

2. Description of the Related Art

In the concrete industry, sidewalks, walkways and parking lots are formed with slabs of concrete. Seams, grooves or other cuts in the concrete may be made in the slabs to form expansion joints, control stress cracks as the slabs cure, or to form channels or openings in the slabs to accept other structures. When these slabs buckle, or when one slab sinks or rises relative to another adjacent slab, a trip hazard to pedestrians traversing the slabs results from the uneven surface between the slabs. Trip hazards can occur on concrete pathways when concrete slabs forming the pathways shift relative to each other, or when a single slab or portion of the hard-surfaced pathway cracks or deforms. Adjacent concrete slabs can shift relative due to frost heaving, ground settling, root intrusions and the like. In some instances, concrete slabs can also buckle due to thermal expansion, creating steep-sided upwardly thrust regions (i.e., buckles).

Radial saws which cut concrete slabs are needed to remove these trip hazards from sidewalks, parking lots, and frequently-traveled thoroughfares and reduce the hazard they pose to pedestrians. Numerous and varied types of stationary, portable and handheld saws are available for cutting through concrete walls or slabs, but they all suffer from various weaknesses and deficiencies. Some saws overheat during use, dulling and shortening the life of the saw blades and creating discomfort for saw operators. Some saws are driven by various species of fuel combustion engines, running at high decibels and emitting noxious exhaust fumes. These saws create dust clouds while in use, which are dangerous for operators to inhale. Other saws are underpowered, or incapable of making flush cuts to concrete surfaces because of saw components jutting below the level of the saw blade. Some saws are heavy and cumbersome because all of the components powering the saw are integrated into the handheld saw, rather than dispersed into a portable drive unit that does not have to be supported during operation.

There exists a need in the art for a simple and effective hydraulically-powered radial saw having a rigid frame, a control handle, and switch assembly having a trigger which when engaged by an operator delivers pressurized hydraulic fluid to a hydraulic drive unit. In some embodiments, this saw should have separate "power pack" or drive unit for powering the saw.

SUMMARY OF THE INVENTION

From the foregoing discussion, it should be apparent that a need exists for a hydraulically-actuated, radial concrete saw and trip hazard removal method. Beneficially, such a saw would overcome many of the difficulties with prior art by providing a more functional apparatus to consumers and professionals which is lighter, quieter, and self-cooling.

The present invention has been developed in response to the present state of the art, and in particular, in response to the problems and needs in the art that have not yet been fully solved by currently available apparatii and methods. Accordingly, the present invention has been developed to provide a portable, hydraulically-powered concrete saw comprising: a rigid metal frame having a forward half and rearward half, the rearward half comprising a shaft collar for receiving a rearward grip assembly; a hydraulic drive system for driving a circular saw blade; a planar shield affixed to the rigid frame, the shield covering a portion of an upper face of the circular saw blade; a hollow, tubular forward handle affixed to one of the frame and the shield for gripping the forward section of the saw; and a rearward grip assembly affixed to rearward half of the metal frame.

The rearward grip assembly comprises a trigger housing defining a hollow interior recess for housing one of a 12 volt electric switch and a hydraulic value; a trigger for activating the hydraulic drive system, the trigger configured to activate one of the 12 volt switch and the hydraulic valve when depressed, the switch and the valve activating the hydraulic drive system; a trigger guard partially enveloping the trigger; an elongated shaft affixed to the trigger housing, the elongated shaft for gripping the rearward section of the saw, the shaft elongated along a longitudinal axis, the shaft coupled to the rigid frame with the shaft collar such that the shaft and rearward grip assembly can be axially rotated around the longitudinal axis of the shaft within the collar.

The saw further comprise an arbor traversing the planar shield, the arbor driven by the hydraulic drive system; a water-cooled hub driven by the arbor, the water-cooled hub defining a plurality of apertures on its outer surface for dispersing the water across an upper face of the circular saw blade; and a coupling affixed to the hub for receiving water delivered to the saw via a water line detachably affixed to the coupling.

The portable, hydraulically-powered concrete saw may further comprise a portable pack for powering the hydraulic saw, the power pack comprising a hydraulic pump connected to the 12 volt switch.

The shield further may comprise a cantilevered skirt circumscribing the outer the edge of the shield, the skirt extending downward to cover the rearward edge of the circular blade.

The portable, hydraulically-powered concrete saw may further comprise a planar under guard affixed to the skirt for covering a portion of a lower face of the circular saw blade.

The shield may define one or more apertures interconnecting the hollow interior of the forward handle with ambient air, the forward handle affixed to a dust abatement hose for sucking pulverized cement debris from the air surrounding the saw blade during saw operation.

The forward half of the frame may diverge into two or prongs. The metal frame may be fabricated from one of steel, aluminum, and titanium. The metal frame further may comprise a spring pin for locking the rearward grip assembly in a fixed position.

A method of severing a concrete trip hazard from a thoroughfare is also disclosed, the steps of the method comprising: powering a hydraulically-actuated, horizontal, flush-cut, radial saw with a portable power source; engaging the trip hazard with the hydraulically-actuated, flush-cut, radial, saw at a first predetermined angle calculated to reduce a height of the trip hazard relative to an adjacent concrete slab; depressing a trigger to activate the saw by, the trigger triggering one of a 12 volt switch and a hydraulic valve; moving the saw laterally from one side of the trip hazard to another to create a first chamfered cut, while concurrently moving the saw forward as the trip hazard is severed; measuring the angle of the first chamfered cut relative to surrounding surface; and determining that the first chamfered cut is in conformity with ADA requirements.

The method may further comprise, in response to the first chamfered cut failing to conform to ADA requirements, again moving the saw laterally from one side of the trip hazard to another to create a second chamfered cut a second predetermined angle differing from the first predetermined angle, while concurrently moving the saw forward as the trip hazard is severed.

The method may further comprise introducing water to the trip hazard as it is severed. The method may further comprise cooling the blade with water dispensed at the center of the blade with water from a flush-cut hub. The method may further comprise logging the removal of the trip hazard in a log file for later remittance to an employing authority.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
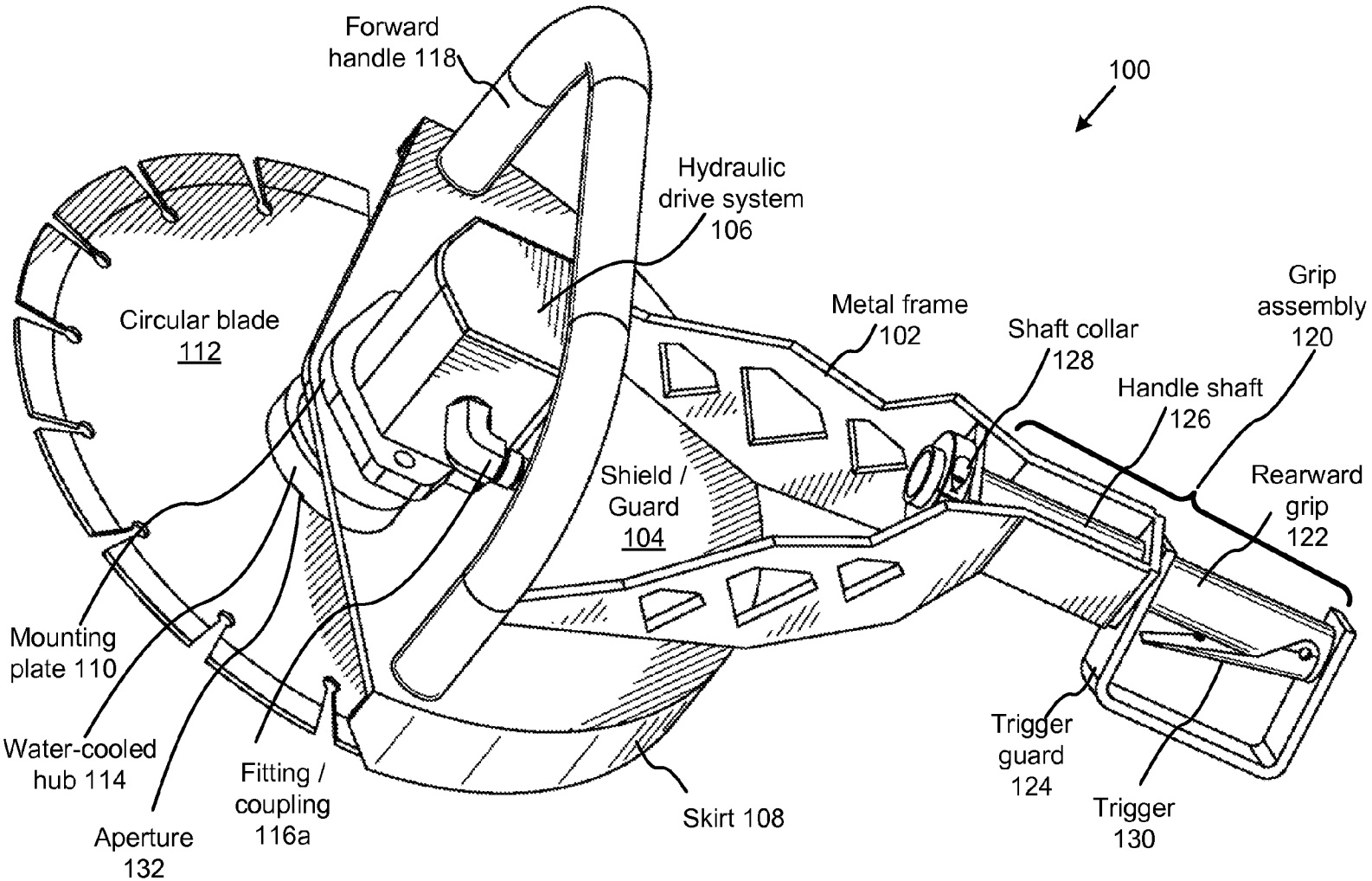
FIG. 1 is a side elevational perspective view of a portable, hydraulically-powered concrete saw in accordance with the present invention.

FIG. 1 is a side elevational perspective view of a portable, hydraulically-powered concrete saw 100 in accordance with the present invention. The concrete saw 100, in the shown embodiment, comprises a metal frame 102, a shield 104 (i.e. guard), a hydraulic drive system 106, a skirt 108, a mounting plate 110, a circular saw blade 112, a water cooled hub 114, a hydraulic coupling 116*a*, a forward handle 118, an aperture 132 (in the hub 114), a dust abatement hose (not shown), and a grip assembly 120, which grip assembly comprises a handle shaft 126, rearward grip 122, a trigger guard 124, a joint collar 128, a trigger 130.

The metal frame 102 is fabricated, in the shown embodiment, from one a rigid polymer, metal, carbon, alloy, wood, glass, elastomeric, or silastic material. The metal frame 102 may define periodic triangular-shaped recesses to reduce its overall weight (which recesses may also be circular, square, polygonal, etc).

The metal frame 102 comprises a proximal end which is affixed to the grip assembly 120 (the proximal end being on the rearward half of the metal frame 102). The metal frame 102 also comprises a distal end which is affixed to the guard 104 (the distal end being on the forward half of the metal frame 102). In the shown embodiment, the metal frame 102 forks, or diverges, into two prongs which are both affixed to the guard 104. In various embodiments, the metal frame 102 may comprise only one non-diverging prong (e.g. fingers), or a plurality of diverging prongs.

In various embodiments, the hydraulic coupling 116*a* and/or the hydraulic drive system 106 may comprise a valve, such as a one way check valve, for preventing hydraulic fluid used to actuate the drive system 106 from reverting back down a hydraulic fluid line affixed to the hydraulic coupling 116*a*.

The guard 104 (i.e. shield) is affixed to the distal end of the metal frame 102. In various embodiments, the guard 104 comprises a semi-circular planar metal component which partially covers the upward side of the circular blade 112. In various embodiments, the guard 104 covers a range of 20 degrees to 300 degrees of the upper side of the circular saw blade 112. In some embodiments, the guard 104 comprises a plurality of stacked planar components which are rotatable axially around an arbor or mandrel traversing the lower end of the housing of the hydraulic drive system 106 to the circular saw blade 112 such that the guard 104 may be adjustably configured by an operator to cover a predetermined portion of the upper side of the circular saw blade 112.

The guard 104, in some embodiments, may comprise elastomeric material. The guard 104 may formed through injection molding, 3D printing, or cast, machined, or stamped.

In the shown embodiment, the guard 104 is affixed to a skirt 108, which comprises a curved, semi-circular metal component jutting orthogonally downward from the outer edge of the guard 104, which skirt 108 partially circumscribes the guard 104. In various embodiments, the skirt 108 may be fabricated, or manufactured, as a single piece, or extension of the guard 104. The skirt 108 protects an operator from concrete debris expelled during operation of the saw 100.

The in the shown embodiment, the guard 104, together with the skirt 108, can form a dust abatement vacuum hood. In these embodiments, the guard 104 doubles as a shell shell for collecting concrete debris during sawing.

As the blade of the concrete saw rotates, pulverized concrete is discharged. In the shown embodiment, this concrete debris may be sucked into apertures underlying the guard 104, and through the forward handle 118, into the dust abatement hose 132. In these embodiments, the dust abatement hose (not shown) is connected to a vacuum on the portable power pack. In other embodiments, apertures for sucking in concrete debris may be found anywhere on the forward half of metal frame 102.

The hydraulic drive system 106 comprises a mechanically actuated hydraulic motor for converting fluid pressure and flow into torque and angular displacement for rotating the blade 112. Alternatively, the hydraulic motor inside the drive system 106 may comprise a hydraulic pump and/or one or more hydraulic cylinders. In the shown embodiment, the hydraulic pump is in a separate power pack connected to the saw 100 with flexible hydraulic lines.

Spur gears or straight-cut gears inside the hydraulic drive system may be used to impart direction, speed or torque to the blade 112. The drive system 106 may comprise an hydraulic gear motor with these gears.

The functional components of the hydraulic drive system 106, including gears and pistons, are housed within a metal housing (shown) to which one or more hydraulic coupling(s) 116 are affixed. In some embodiments, a vacuum tube is also affixed to the housing for sucking in and reducing airborn dust created while cutting concrete or removing trip hazards from concrete slabs. In other embodiments, pulverized concrete debris are removed through the dust abatement hose (not shown), which debris is intaken through aperture in the guard 104.

The hydraulic drive system 106 comprises face seals, o-rings, and gaskets to prevent leakage of hydraulic fluid as known to those of skill in the art. In various embodiments, the working components of the hydraulic drive system 106 are isolating atmospherically from the ambient air.

In some embodiments, the saw 100 is driven by an electric motor or pneumatically.

Two couplings 116 (or fittings) are screwably affixed to the drive system 106. These couplings 116*a-b* input and output pressurized hydraulic fluid into the drive system 106. In the shown embodiment, the couplings 116*a* inputs hydraulic fluid into the drive system 106 from an hydraulic line.

The mounting plate 110 is affixed to the guard 104 between the upper side of the guard 104 and the lower end of the drive system 106. The mounting plate 110 is known to those of skill in the art, and comprises all the bearing and gaskets necessary to effectuate fluid movement of a mandrel, or drive shaft, traversing the mounting plate 110 and the guard 104 to the circular blade 112.

The circular blade 112 is known to those of skill in the art, but is modified in the present invention to include apertures (described in relation to FIG. 2), for dispersing water across the bottom-side of the circular blade 112. The circular blade 112 may also comprise a raised, or recesses, toroidal rim circumscribing its perimeter.

The rearward grip can be locked in place with a spring pin on the frame after the grip is axially rotated.

The drive system 106 interconnects a hydraulic motor in a driving relationship with an arbor and/or drive wheel, which drive(s) the blade 112.

The saw blade 112, in the shown embodiment, comprises a diamond segmented blade 112.

A self-propelled hydraulic power supply vehicle and tool mounting platform having an hydraulic fluid reservoir integral with and forming the structural frame of the vehicle, hydraulically actuated driving and steering apparatus for moving the vehicle across a support surface while performing a cutting operation on the support surface, and castor wheels facilitating vehicle mobility which are rotated into operative position raising the vehicle so that the wheels normally supporting the vehicle are raised out of contact with the surface for mobility when the device is not cutting the support surface.

The fitting/inlet comprises, in the shown embodiment, a male-male fitting design to receive female threaded bosses on a hose, tube or pipe conveying the pressurized hydraulic fluid to the drive system.

The cylindrical body 102 may be transparent. In those embodiments, the cylindrical body 102 comprise linear measuring lines for visually determining the quantity of contents in the receptacle 104.

In various embodiments, the portion of the cylindrical body resting aft of the hole (i.e. between the distal end and the hole) constitutes the receptacle 104. This receptacle 104 is used for receiving contents from the container, and temporarily holding these contents before dispensing them in accordance with the wishes of a use.

In some embodiments, the circular saw blade 112 comprises one or more annular rings defining hollow channels interconnected via the blade 112 to the hub 114, which allow water to flow onto the remote side, or lower side, of the blade 112.

The saw 100 may include a hydraulic pump operable to supply pressurized hydraulic fluid. This pump may also be housing in a separate power pack. Yet further, the saw 100 may includes a flow sharing valve fluidly coupled to the hydraulic drive system to distribute the pressurized hydraulic fluid from the hydraulic pump in the portable power pack.

Figure 2:
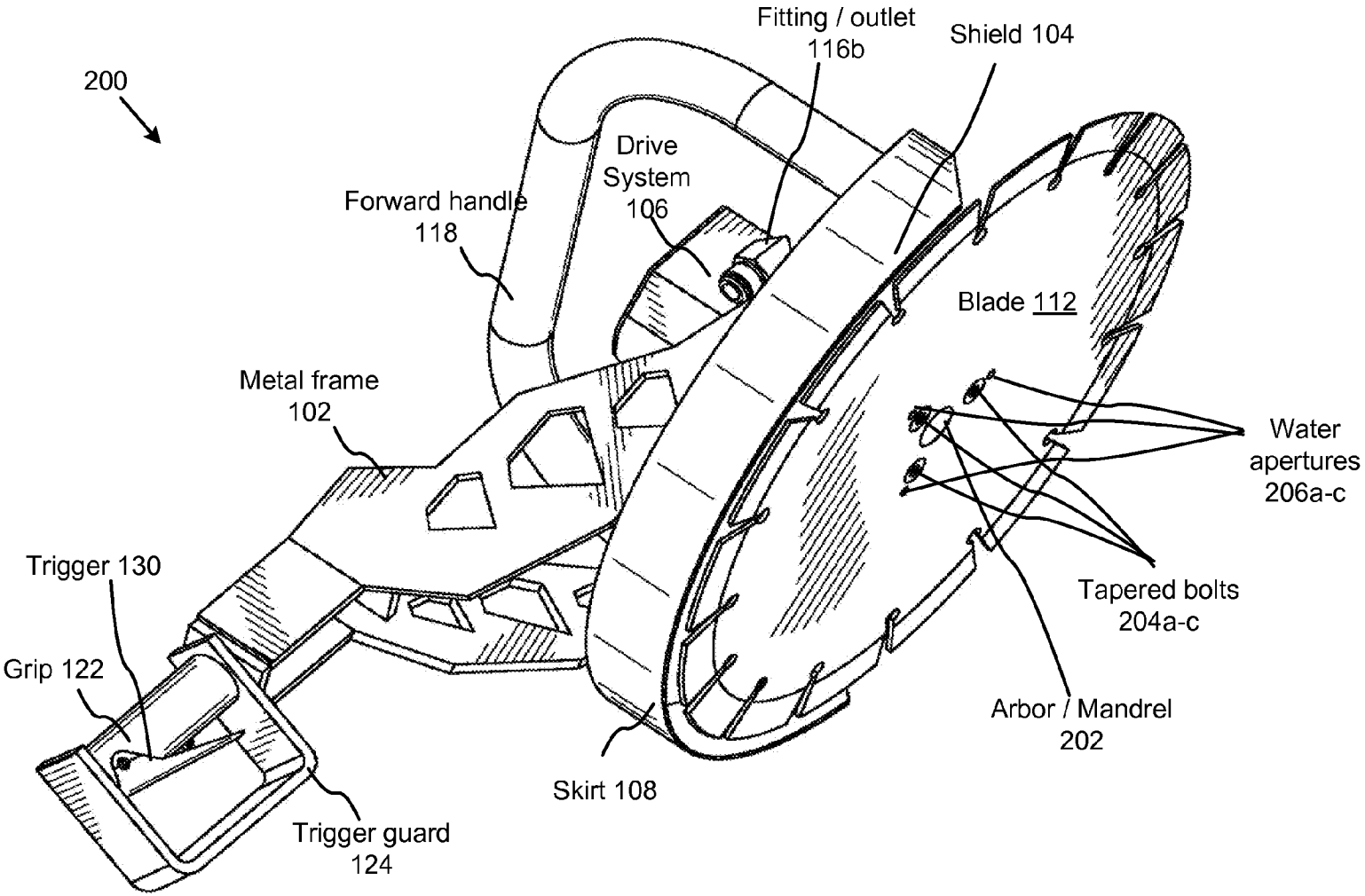
FIG. 2 is a lower-side perspective view of a portable, hydraulically-powered concrete saw in accordance with the present invention.

FIG. 2 is a lower-side perspective view of a portable, hydraulically-powered concrete saw 200 in accordance with the present invention. The concrete saw 100, in the shown embodiment, comprises a metal frame 102, a shield 104 (i.e. guard), a hydraulic drive system 106, a skirt 108, a circular saw blade 112, a coupling 116*a*, a forward handle 118, an water apertures 206*a-c*, bolts 204*a-c*, an arbor 202, and a rearward grip 122, a trigger guard 124, and a trigger 130.

The frame 102, drive system 106, skirt 108, saw blade 112, coupling 116*a*, forward handle 118, rearward grip 122, trigger guard 124 and trigger 130 are all substantially described above in relation to FIG. 1.

The drive system 106 may be powered by a hydraulic pump in a separate power pack. The power pack may also comprise a vacuum for abating dust from the saw 200. As discussed above, the trigger 130 activates a 12 volt electric switch, which switch activated the hydraulic pump in the power pack.

The saw 200 comprises tapered bolts 204*a-c* countersunk into the diamond segmented blade 112. The saw 200 may comprise any number of a plurality of tapered bolts 204*a-c*.

The water apertures 206*a-c* comprise recesses in the blade 112 through which water, or coolant, flows onto the remote side of the blade 112 and is centrifugally forced by the motion of the blade 112 to the periphery edges of the blade 112. In those embodiments, is forced through the water apertures 206*a-c* from an annular grove on the near, or upper, side of the blade 112. Water is forced into this annular groove by the water cooled hub 114, which receives water via a water line connected to the hub 114.

Thus, in the shown embodiment, four lines interconnect the saw 200 and a power pack, including a water line for unilaterally sending water to hub 114, two hydraulic lines for carrying hydraulic fluid to and from the drive system 106, and an electrical line for carrying an electric signal from the trigger 130 to the hydraulic pump in the power pack.

Figure 3:
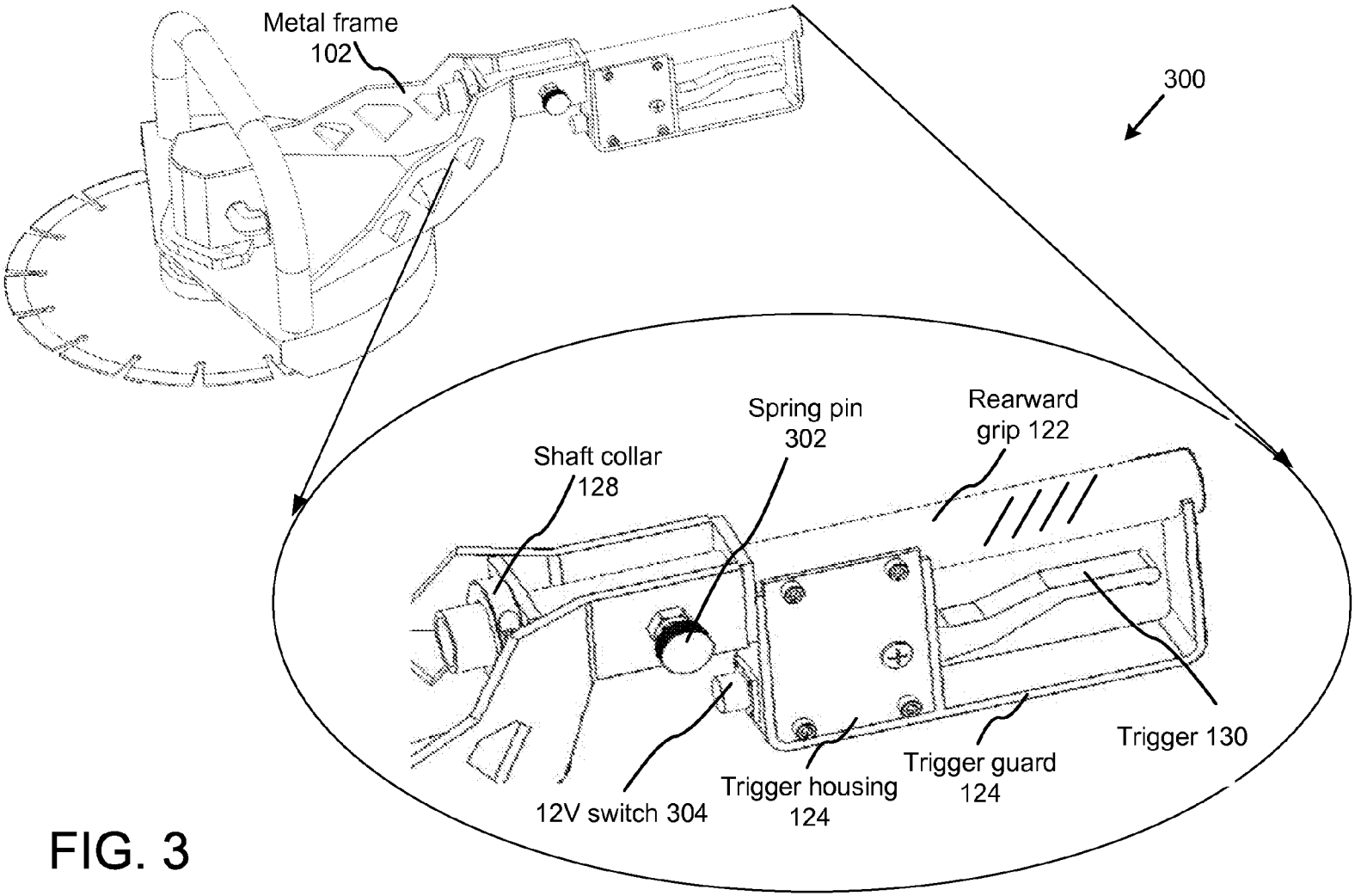
FIG. 3 is a side elevational perspective view of a portable, hydraulically-powered concrete saw with an exploded view of a trigger assembly in accordance with the present invention.

FIG. 3 is a side elevational perspective view of a portable, hydraulically-powered concrete saw 300 with an exploded view of a trigger assembly in accordance with the present invention. The saw 300 comprises a metal frame 102 and a trigger assembly comprising a rearward grip 122, a trigger guard 124, a trigger 130, a trigger housing 302, a 12 volt switch, and a spring pin 306.

The frame 102, trigger guard 124 and trigger 130 are all substantially described above in relation to FIG. 1-2.

FIG. 3 is meant to highlight the fact that the grip assembly 120 may vary from one embodiment to another. In various embodiments, the trigger 130 activates a 12 volt switch 304 housed within the trigger housing 302.

The trigger housing 302 defines a hollow interior recess for housing either a 12 volt switch, which switch activated a hydraulic pump and drives the drive system 106; or, alternatively, the trigger housing 302 houses a valve on the hydraulic line, which valve releases hydraulic fluid to the drive system 106.

As described above, the grip assembly 120 is affixed to the metal frame 102 with a shaft collar 128. The grip assembly 120 rotates axially within the shaft collar 128. In the shown embodiment, the axial position of grip assembly relative to the metal frame 102 may fixed using a spring pin 306 which insertably engages and interlocks with grooves in the shaft 126.

Figure 4:
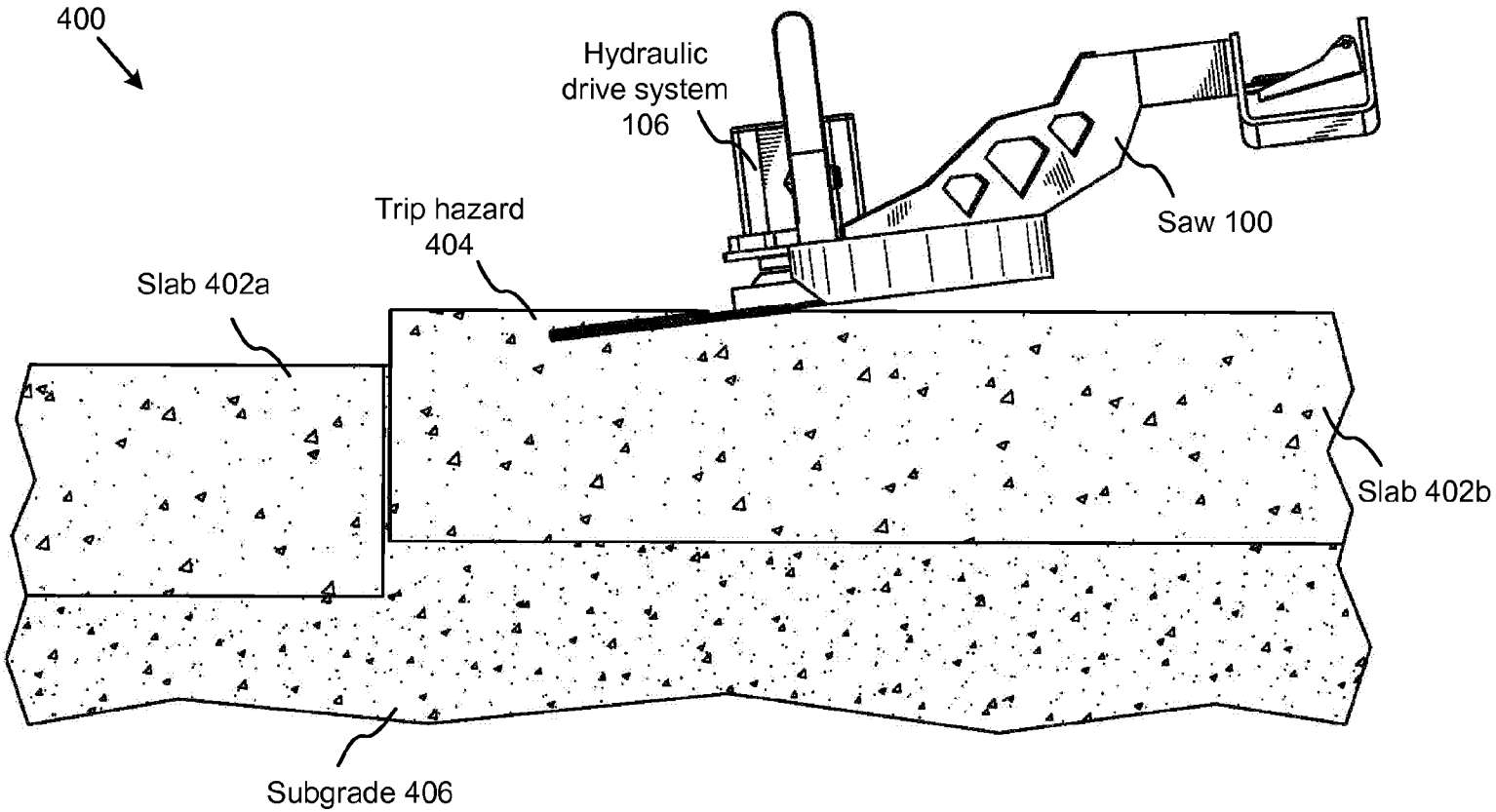
FIG. 4 is a side perspective view of a portable, hydraulically-powered concrete saw being used to perform a chamfer cut in accordance with the present invention.

FIG. 4 is a side perspective view of a portable, hydraulically-powered concrete saw being used to perform a chamfer cut in accordance with the present invention.

A trip hazard 404 exists at the junction of slab 402*a* with slab 402*b*. It is necessary to remove this trip hazard 404 by sawing a chamfer cut across the edge of slab 402*b*. The slabs 402*a-b* rest on a subgrade 406. A chamfer cut is made into the trip hazard 404 by moving the concrete saw 300 laterally across the trip hazard 404. In some embodiments, multiple chamfer cuts must be made such that the rise-to-run ratios imposed on chamfer cuts by employers or law are maintained.

Figure 5:
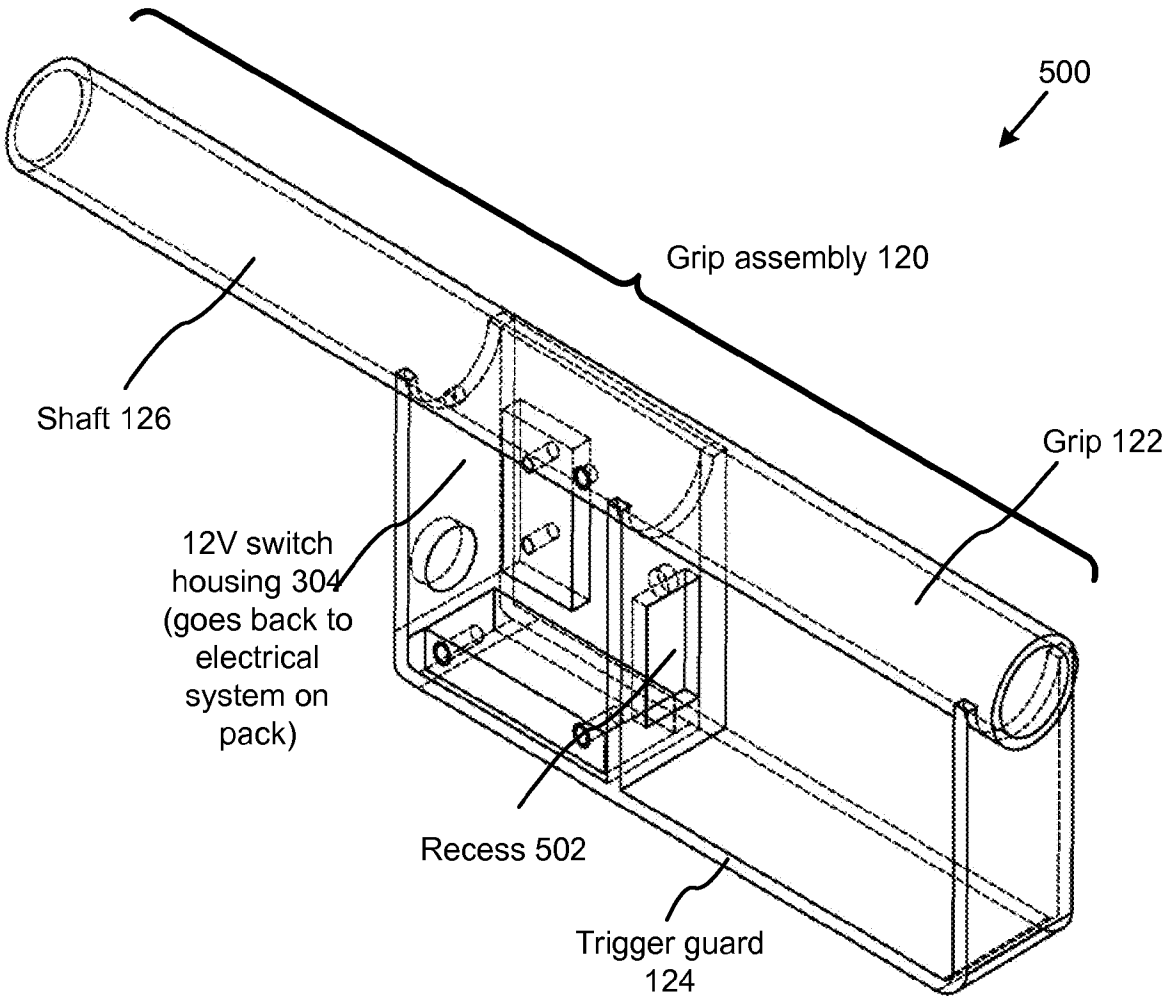
FIG. 5 is a lower-side perspective view of a trigger assembly for a portable, hydraulically-powered concrete saw in accordance with the present invention.

FIG. 5 is a lower-side perspective view of a trigger assembly 500 for a portable, hydraulically-powered concrete saw in accordance with the present invention. The trigger assembly comprises a grip 122, a shaft 126, a housing 304 defining a recess 502, and a trigger guard 124.

The portable radial saw 100 incorporates the assembly 500. The assembly 500 may also comprise a valve assembly in place of the 12 v switch, which when engaged by an operator, delivers pressurized water to powered the hydraulic drive system 106, a spur the hub 114 to drive the blade 112, which hub 114 dispersed water across the blade 112 when the saw 100 is operational.

Figure 6:
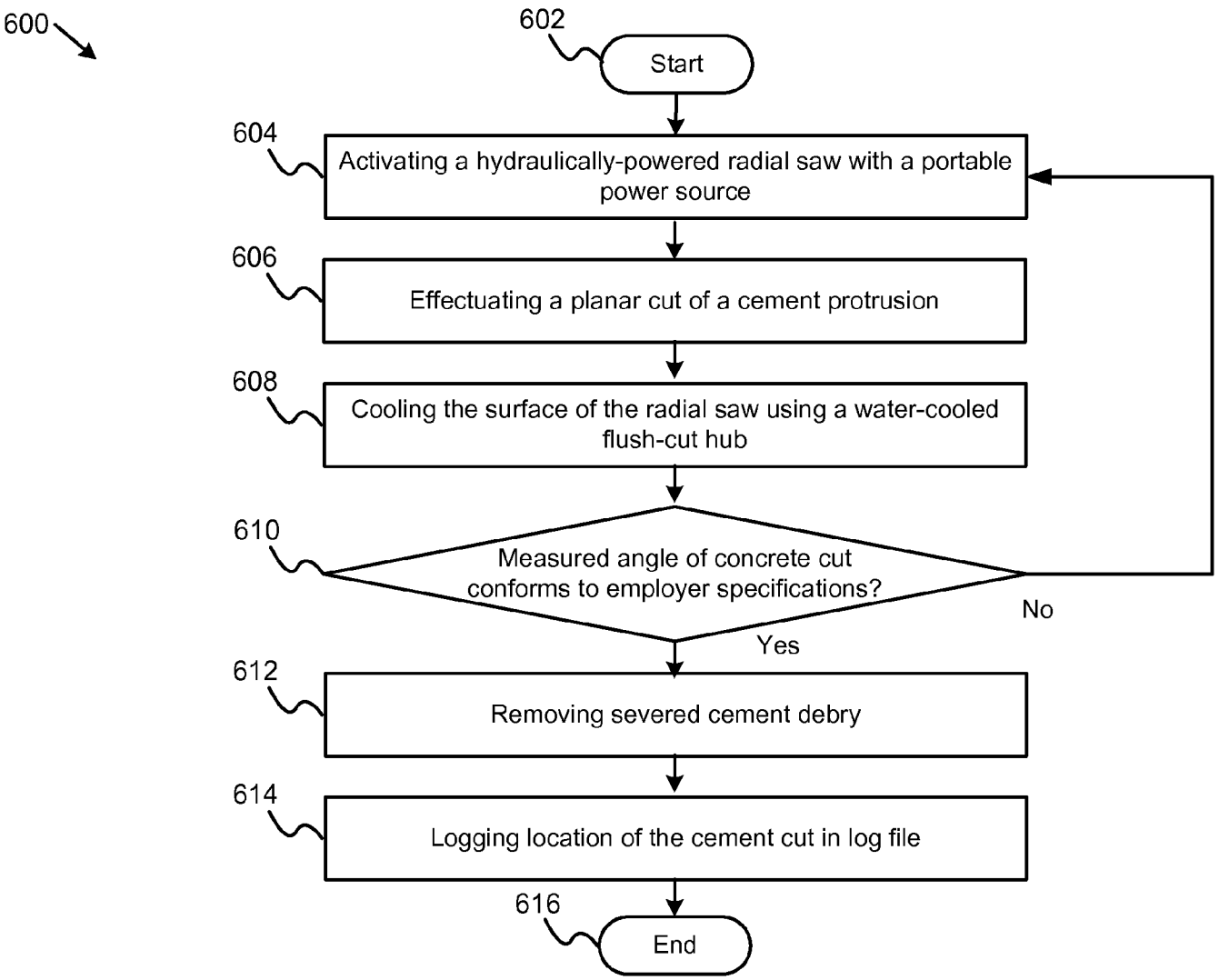
FIG. 6 is a flow chart diagram of a method of removing a concrete trip hazard in accordance with the present invention.

FIG. 6 is a flow chart diagram of a method 600 of removing a concrete trip hazard in accordance with the present invention.

The method 600 begins with activating 604 a hydraulically-powered radial saw, such as saw 100, 200 or 300, with a portable power pack. A cut, such as a chamfer cut, if effectuated 606 using the hydraulically-powered radial saw. The blade 112 of the saw is cooled 608 using water.

If the chamfer cut made to the concrete meets with predetermined specifications, such as those set by the American's with Disabilities Act (ADA), the method 600 proceeds and pulverized concrete debris is removed 612, then the removal of the trip hazard is recorded in a log book 614. If the chamfer cut is not made to specifications, the method 600 returns to step 604.

Figure 7B:
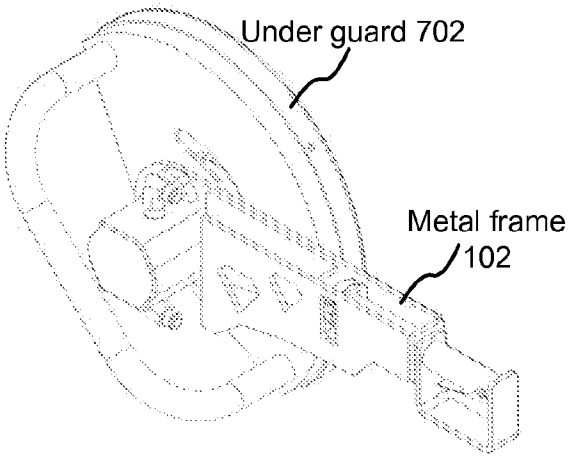
FIG. 7B is an upper-side perspective view of a portable, hydraulically-powered, vertical concrete saw in accordance with the present invention.
Figure 7C:
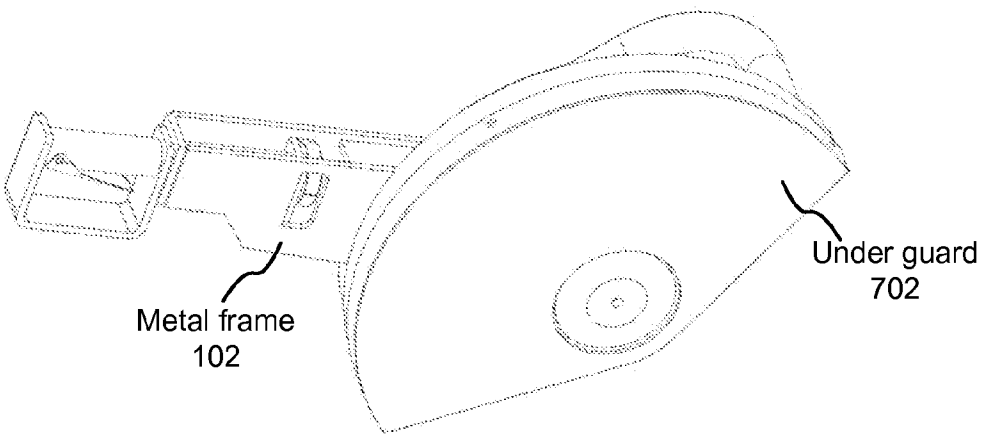
FIG. 7C is a lower-side perspective view of a portable, hydraulically-powered, vertical concrete saw in accordance with the present invention.
Figure 7A:
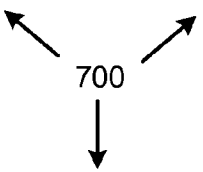
FIG. 7A is an upper-frontal perspective view of a portable, hydraulically-powered, vertical concrete saw in accordance with the present invention.
Figure 7A:
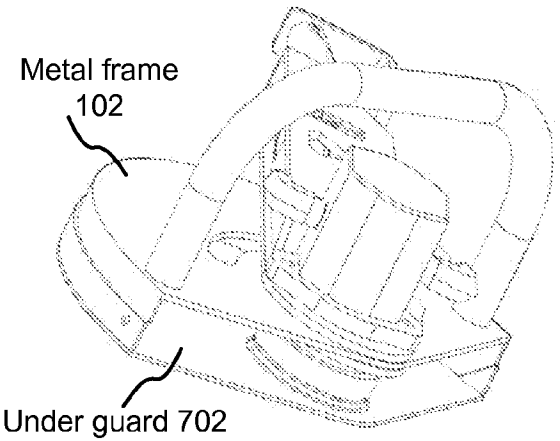

FIG. 7A is an upper-frontal perspective view of a portable, hydraulically-powered, vertical concrete saw 700 in accordance with the present invention. The saw 700 comprises the same components as saw 300, but with the addition of an under guard 702.

The under guard 702, like the guard 104, comprises a planar metal or polymer shield which partially envelopes the blade 112. The under guard 702, however, covers the remote side of the blade 112 rather than the upper side of the blade 112 and is affixed to the skirt 108 in the shown embodiment. In other embodiments, the under guard 702 may be affixed directly to the metal frame 102.

The present invention disclosed a vertical, or chop saw, which can be used to make vertically running cuts in concrete.

FIG. 7B is an upper-side perspective view of a portable, hydraulically-powered, vertical concrete saw 700 in accordance with the present invention. FIG. 7B provides another perspective view of the saw 700

FIG. 7C is a lower-side perspective view of a portable, hydraulically-powered, vertical concrete saw 700 in accordance with the present invention. FIG. 7C provides another perspective view of the saw 700.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable, hydraulically-powered horizontal concrete saw comprising:

a rigid metal frame having a forward half and rearward half, the rearward half comprising a shaft collar for receiving a rearward grip assembly;

a hydraulic drive system for driving a mounted circular saw blade in a substantially horizontal orientation;

the mounted circular saw blade having an upper face towards the rigid frame and a lower face opposite the upper face;

a planar shield affixed to the rigid frame, the shield covering a portion of the upper face of the circular saw blade;

an arbor traversing the planar shield, the arbor driven by the hydraulic drive system;

a water-cooled hub driven by the arbor, the water-cooled hub arranged to mount the circular saw blade so that no rigid saw mounted features extend below the lower face of the circular saw blade and defining a plurality of apertures on the hub outer surface for dispersing the water across the upper face of the circular saw blade;

a hollow, tubular forward handle affixed to one of the rigid frame and the shield for gripping the forward half of the saw and operating the saw with the circular saw blade it in a substantially horizontal orientation;

the rearward grip assembly affixed to the rearward half of the rigid frame, the rearward grip assembly comprising:

a trigger housing defining a hollow interior recess for housing one of a 12 volt electric switch and a hydraulic value;

a trigger for activating the hydraulic drive system, the trigger configured to activate one of the 12 volt switch and the hydraulic valve when depressed, the switch and the valve activating the hydraulic drive system;

a trigger guard partially enveloping the trigger;

an elongated shaft affixed to the trigger housing, the elongated shaft for gripping the rearward half of the saw, the shaft elongated along a longitudinal axis, the shaft coupled to the rigid frame with the shaft collar such that the shaft and the rearward grip assembly can be axially rotated around the longitudinal axis of the shaft within the collar.

2. The portable, hydraulically-powered concrete saw of claim 1, further comprising a portable pack for powering the hydraulic saw, the power pack comprising a hydraulic pump connected to the 12 volt switch.

3. The portable, hydraulically-powered concrete saw of claim 1, wherein the shield further comprises a cantilevered skirt circumscribing the outer the edge of the shield, the skirt extending downward to cover the rearward edge of the circular saw blade without a rigid structure extending below the lower face of the circular saw blade.

4. The portable, hydraulically-powered concrete saw of claim 1, wherein the forward half of the rigid frame diverges into two or prongs.

5. The portable, hydraulically-powered concrete saw of claim 1, wherein the rigid frame is fabricated from one of steel, aluminum, and titanium.

6. The portable, hydraulically-powered concrete saw of claim 1, wherein the rigid frame further comprises a spring pin for locking the rearward grip assembly in a fixed position.

7. A portable, hydraulically-powered concrete saw comprising:

a rigid metal frame having a forward half and rearward half, the rearward half comprising a shaft collar for receiving a rearward grip assembly;

a hydraulic drive system for driving a mounted circular saw blade in a substantially horizontal orientation;

the mounted circular saw blade having an upper face towards the rigid frame and a lower face opposite the upper face;

a planar shield affixed to the rigid frame, the shield covering a portion of the upper face of the circular saw blade;

a cantilevered skirt circumscribing the outer the edge of the shield, the skirt extending downward to cover the rearward edge of the circular saw blade without a rigid structure extending below the lower face of the circular saw blade;

an arbor traversing the planar shield, the arbor driven by the hydraulic drive system;

a water-cooled hub driven by the arbor, the water-cooled hub arranged to mount the circular saw blade so that no rigid saw mounted features extend below the lower face of the circular saw blade and defining a plurality of apertures on the hub outer surface for dispersing the water across an upper face of the circular saw blade;

a hollow, tubular forward handle affixed to one of the rigid frame and the shield for gripping the forward half of the saw and operating the saw with the circular saw blade it in a substantially horizontal orientation;

the rearward grip assembly affixed to the rearward half of the rigid frame, the rearward grip assembly comprising:

a trigger housing defining a hollow interior recess for housing one of a 12 volt electric switch and a hydraulic value;

a trigger for activating the hydraulic drive system, the trigger configured to activate one of the 12 volt switch and the hydraulic valve when depressed, the switch and the valve activating the hydraulic drive system;

a trigger guard partially enveloping the trigger;

an elongated shaft affixed to the trigger housing, the elongated shaft for gripping the rearward half of the saw, the shaft elongated along a longitudinal axis, the shaft coupled to the rigid frame with the shaft collar such that the shaft and the rearward grip assembly can be axially rotated around the longitudinal axis of the shaft within the collar;

a spring pin for locking the rearward grip assembly in a fixed position.

8. A method of severing a concrete trip hazard from a thoroughfare, the steps of the method comprising:

providing a portable, hydraulically-powered horizontal concrete saw comprising:

a rigid metal frame having a forward half and rearward half, the rearward half comprising a shaft collar for receiving a rearward grip assembly;

a hydraulic drive system for driving a mounted circular saw blade in a substantially horizontal orientation;

the mounted circular saw blade having an upper face towards the rigid frame and a lower face opposite the upper face;

a planar shield affixed to the rigid frame, the shield covering a portion of the upper face of the circular saw blade;

an arbor traversing the planar shield, the arbor driven by the hydraulic drive system;

a water-cooled hub driven by the arbor, the water-cooled hub arranged to mount the circular saw blade so that no rigid saw mounted features extend below the lower face of the circular saw blade and defining a plurality of apertures on the hub outer surface for dispersing the water across the upper face of the circular saw blade;

a hollow, tubular forward handle affixed to one of the rigid frame and the shield for gripping the forward half of the saw and operating the saw with the circular saw blade it in a substantially horizontal orientation;

the rearward grip assembly affixed to the rearward half of the rigid frame, the rearward grip assembly comprising:

a trigger housing defining a hollow interior recess for housing one of a 12 volt electric switch and a hydraulic value;

a trigger for activating the hydraulic drive system, the trigger configured to activate one of the 12 volt switch and the hydraulic valve when depressed, the switch and the valve activating the hydraulic drive system;

a trigger guard partially enveloping the trigger;

an elongated shaft affixed to the trigger housing, the elongated shaft for gripping the rearward half of the saw, the shaft elongated along a longitudinal axis, the shaft coupled to the rigid frame with the shaft collar such that the shaft and the rearward grip assembly can be axially rotated around the longitudinal axis of the shaft within the collar powering the hydraulically-powered horizontal concrete saw with a portable power source;

engaging the trip hazard with the hydraulically-powered horizontal concrete saw at a first predetermined angle calculated to reduce a height of the trip hazard relative to an adjacent concrete slab;

depressing the trigger to activate the saw, the trigger triggering one of the 12 volt switch and the hydraulic valve;

moving the saw laterally from one side of the trip hazard to another to create a first chamfered cut, while concurrently moving the saw forward as the trip hazard is severed;

measuring the angle of the first chamfered cut relative to surrounding surface; and determining that the first chamfered cut is in conformity with ADA requirements.

9. The method of claim 8, further comprising, in response to the first chamfered cut failing to conform to ADA requirements, again moving the saw laterally from one side of the trip hazard to another to create a second chamfered cut a second predetermined angle differing from the first predetermined angle, while concurrently moving the saw forward as the trip hazard is severed.

10. The method of claim 8, further comprising introducing water to the trip hazard as it is severed.

11. The method of claim 8, cooling the blade with water dispensed at the center of the blade with water from water-cooled hub.

12. The method of claim 8, further comprising logging the removal of the trip hazard in a log file for later remittance to an employing authority.

* * * * *